US007766082B2

(12) United States Patent
Teixeira

(10) Patent No.: US 7,766,082 B2
(45) Date of Patent: Aug. 3, 2010

(54) FLEXIBLE LINER FOR DRILLED DRAINHOLE DEPLOYMENT

(75) Inventor: Jose Teixeira, Chaville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/103,740

(22) Filed: Apr. 16, 2008

(65) Prior Publication Data

US 2009/0101363 A1 Apr. 23, 2009

(30) Foreign Application Priority Data

Apr. 17, 2007 (EP) ..... 07106326

(51) Int. Cl.
*E21B 43/08* (2006.01)

(52) U.S. Cl. ..... 166/231; 166/50; 166/384

(58) Field of Classification Search ..... 166/384, 166/231, 232, 236, 50
See application file for complete search history.

(56) References Cited

U.S. PATENT DOCUMENTS

| | | | | | |
|---|---|---|---|---|---|
| 463,759 | A | * | 11/1891 | Monjeau | 166/232 |
| 673,398 | A | * | 5/1901 | Keller et al. | 175/19 |
| 776,392 | A | * | 11/1904 | Harmon | 166/232 |
| 2,120,983 | A | * | 6/1938 | Layne | 166/233 |
| 2,797,893 | A | | 7/1957 | McCune | |
| 2,804,926 | A | | 9/1957 | Zublin et al. | |
| 3,548,937 | A | * | 12/1970 | Kiel | 166/232 |
| 4,402,551 | A | * | 9/1983 | Wood et al. | 299/5 |
| RE31,604 | E | * | 6/1984 | Bearden et al. | 166/232 |
| 5,095,990 | A | * | 3/1992 | Best et al. | 166/369 |
| 5,311,942 | A | * | 5/1994 | Nagaoka | 166/232 |
| 5,938,925 | A | * | 8/1999 | Hamid et al. | 210/497.1 |
| 6,298,914 | B1 | * | 10/2001 | Spray et al. | 166/227 |
| 6,679,334 | B2 | * | 1/2004 | Johnson et al. | 166/380 |
| 7,287,684 | B2 | * | 10/2007 | Blackburne, Jr. | 228/130 |
| 7,448,501 | B2 | * | 11/2008 | Smith | 210/499 |
| 2002/0179306 | A1 | | 12/2002 | Johnson et al. | |
| 2004/0149435 | A1 | * | 8/2004 | Henderson | 166/250.15 |
| 2004/0261994 | A1 | | 12/2004 | Nguyen et al. | |
| 2006/0201873 | A1 | * | 9/2006 | Smith | 210/497.01 |
| 2007/0040557 | A1 | * | 2/2007 | Johnstad et al. | 324/324 |

FOREIGN PATENT DOCUMENTS

| | | |
|---|---|---|
| EP | 0527426 | 2/1993 |
| EP | 0701041 | 3/1996 |
| WO | 0192680 | 12/2001 |
| WO | 0201043 | 1/2002 |

* cited by examiner

*Primary Examiner*—Shane Bomar
(74) *Attorney, Agent, or Firm*—Myron K. Stout

(57) ABSTRACT

A liner for inserting into a drain hole, comprising a resilient tubular member with a central bore; wherein the tubular member is formed from a first continuous helically wound wire provided with a passageway to allow fluid communication across the member.

13 Claims, 6 Drawing Sheets

FIG.7
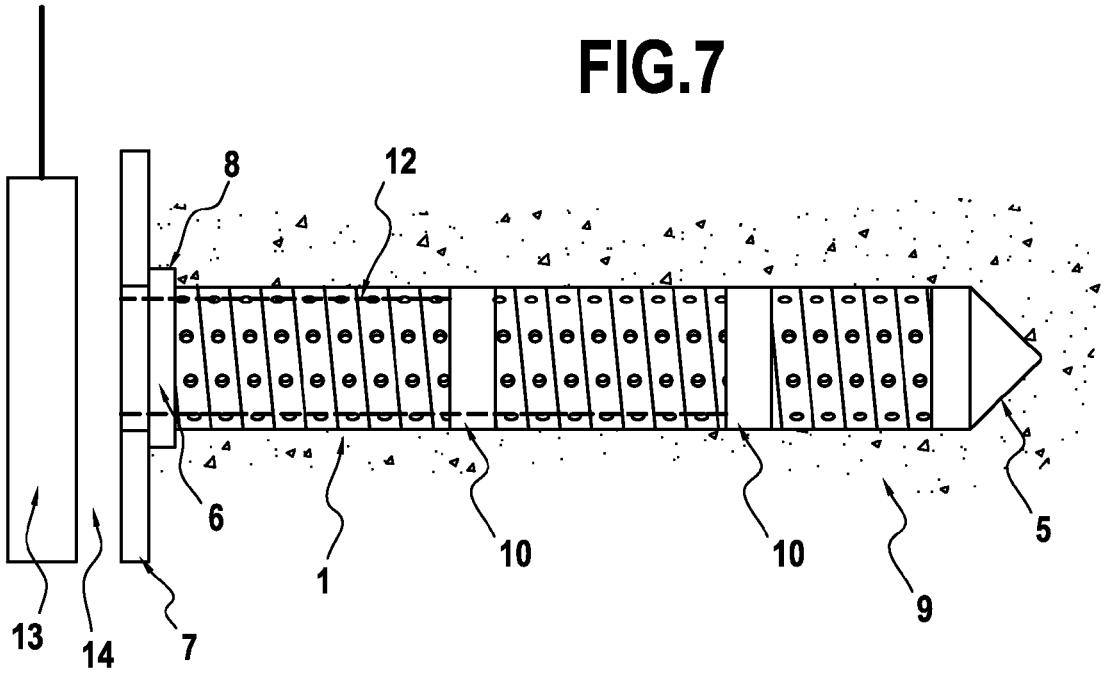
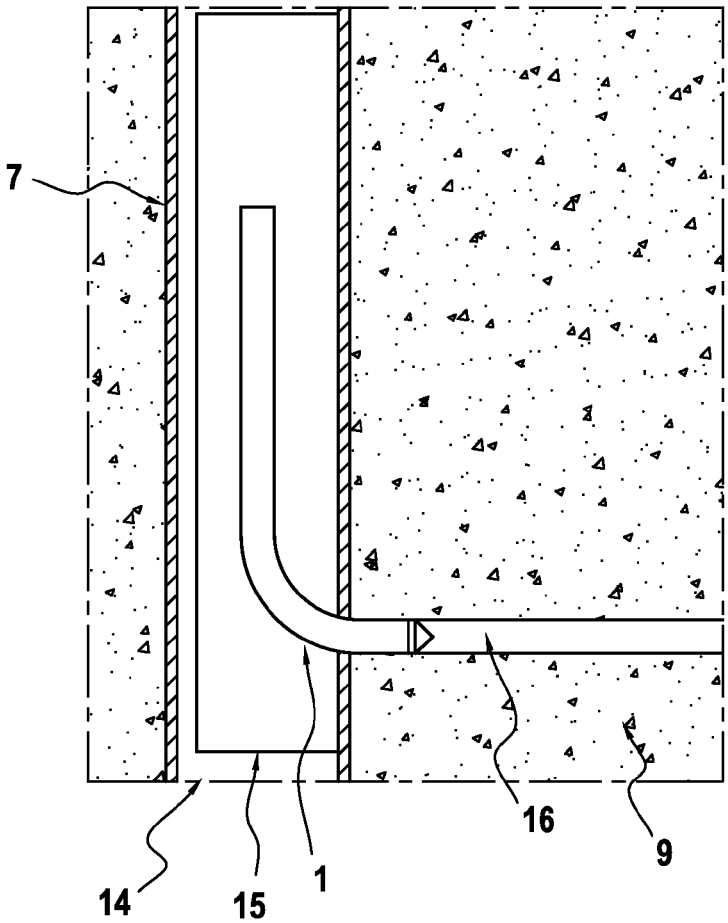
FIG.8

FLEXIBLE LINER FOR DRILLED DRAINHOLE DEPLOYMENT

TECHNICAL FIELD

This invention relates to borehole liners and in particular to flexible liners that can be deployed from a main borehole to a lateral drain hole.

BACKGROUND ART

When drilling undergrounds well such as for oil, gas or water, a borehole is drilled from the surface to the fluid bearing formation. Such formations often have significant horizontal extent but a limited vertical extent. Therefore it is advantageous to drill non-vertical boreholes, also called deviated, lateral or horizontal boreholes, in the subterranean production zone (the reservoir) to increase the production flow rate of the fluids from the lateral to the main borehole. Often these lateral boreholes are boreholes drilled from a main vertical borehole, see FIG. 10. These lateral holes departing from an existing borehole into the production fluid reservoir are called drain holes.

The lateral drain holes can be unconsolidated and to maintain their stability the boreholes can be kept open by inserting tubular liners down at least a partial and up to a total length of the borehole. Perforated liners are used in sand control applications in lateral boreholes. In this type of application generally wire, wire mesh or filtering screens are wrapped around and welded to the perforated liner, which is a base pipe, to filter out sand from fluid drawn out of the reservoir. For example the sands control screens described in WO 03091535 and U.S. Pat. No. 5,849,188.

One of the problems with lateral wells is that to deploy a liner or other downhole tool into the lateral borehole requires the liner to have the ability to negotiate the bend from a tool deployed down the main borehole into the lateral drain holes, as the lateral drain holes are typically formed at an angle of 90° from the main borehole. A guide that is part of the tool deploying the liner causes the liner to bend, so that it can go from the main borehole to the lateral drain hole, and applies curvature to the liner and orientates the liner into the formation. However the base pipes of the liners often do not provide much flexibility for inserting the liner into a lateral borehole from a main borehole.

This invention provides a liner that is flexible so it can be easily deployed into a lateral drain hole that is at any angle from the main borehole.

DISCLOSURE OF THE INVENTION

One aspect of the invention comprises a liner for inserting into a drain hole comprising a resilient tubular member with a central bore; wherein the tubular member is formed from a first continuous helically wound wire provided with a passageway to allow fluid communication across the member.

The helically wound wire forms a coiled spring-like structure resulting in a flexible tubular member. Being flexible the liner can easily go around the corner from a main borehole to a lateral drain hole with a small radius of curvature.

The tubular member can further comprises a second continuous helically wound wire residing concentrically within the first helically wound wire. Having two or more spring-like structures forming the tubular member helps with the rotation of the liner.

Fluid communication from the outside of the liner to the inside of the liner can occur by bores in the wire of the tubular member. Preferably the bores are circular. Alternatively the fluid communication across the liner is caused by spaces between adjacent coils of the wire.

The wire typically has a polygonal cross section, preferably a rectangular or square cross section.

The liner can comprise a liner shoe which closes one end of the tubular member. Preferably the liner shoe is in the shape of a cone. Having a liner shoe closing one end of the tubular member helps the introduction of the liner into the drain hole and guiding the liner down the hole.

The liner can further comprise a bearing at one end of the tubular member. The bearing preferably comprises anchoring means to hold the liner in place. The anchoring means can be flexible or articulated arms. Once the liner has been inserted into the lateral drain hole the anchoring means can hold the liner in places by securing themselves to the formation side of the casing of the main borehole.

In one embodiment the liner can further comprise sensors. Positioning sensors on the liner helps their insertion into lateral drain holes. The liner further comprises an antenna. The antenna allows the powering of the sensors and the transmission of data to and from the sensors and an interrogating tool in the main borehole. The liner can also further comprise a flow rate controlling device.

The liner can be used as a sand control screen in lateral drain holes.

A second aspect of the invention comprises a method of deploying a liner down a borehole comprising inserting the liner as described above down a borehole and guiding the liner into a lateral drain hole from the main borehole. Preferably the liner is guided into a lateral drain hole perpendicular to the main borehole. The liner can be deployed into a lateral drain hole in order to consolidate the drain hole, to screen the fluid, to deploy sensors and/or to deploy control devices inside the drain hole.

BRIEF DESCRIPTION OF THE DRAWINGS

FIG. 7 shows an embodiment of the liner according to the invention in a horizontal drain hole; and FIG. 8 shows a liner according to the invention being inserted into a horizontal drain hole from a main borehole.

MODE(S) FOR CARRYING OUT THE INVENTION

Figure 1:
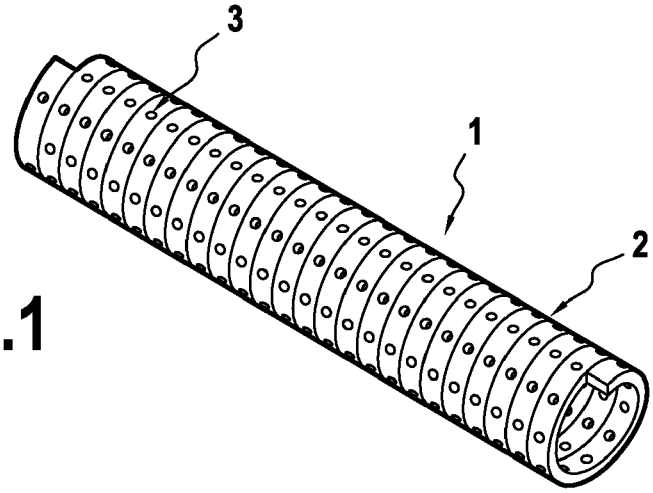
FIG. 1 shows an embodiment of the liner according to the invention.
Figure 2:
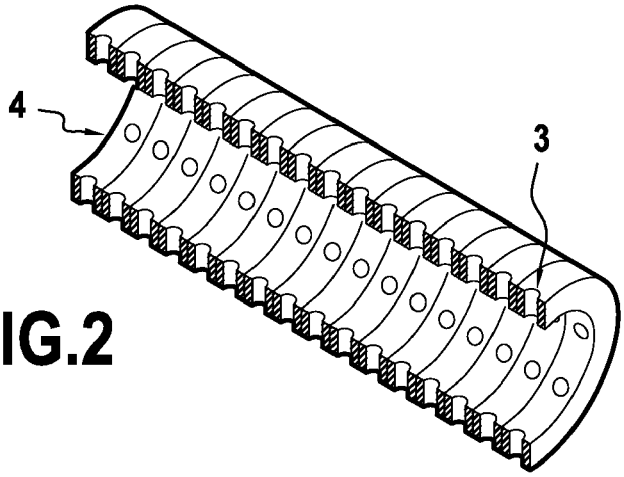
FIG. 2 shows a cutaway view of an embodiment of the liner according to the invention.
Figure 3:
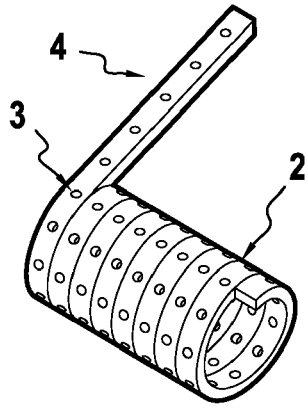
FIG. 3 shows forming an embodiment of the liner according to the invention.

FIGS. 1 and 2 show a first embodiment of the liner of the invention for a lateral drain hole. The liner 1 comprises a tubular member 2 having a central bore formed from a continuous helically wound wire having holes 3 formed in the wire 4. Adjacent coils of the helically wound wire contact each so that the wire forms a tubular structure. The wire 4 forming the tubular member has a rectangular cross section. Other cross section shapes can be used, such as triangular, circular or square, however a square or rectangular cross section is preferred. The wire of adjacent coils fully contact each other, so that fluid communication across the tubular member is restricted to the holes 3 in the wire 4. The holes in the wire allow oil and/or gas flow across the liner into the well from the surrounding formation. The distribution and size of the holes will affect the flow rate of the fluid from the well. Therefore to ensure that well productivity is not impaired the dimension of the holes will vary depending on the dimensions of the particles and the flow rate of the fluid in the reservoir where the horizontal drain hole has been drilled. The holes may be circular or slots in the wire, and the distribution of the holes may vary along the length of the liner. With reference to FIG. 3 the holes 3 are formed during the production of the wire 4 and then the wire is formed into a tubular member 2 by continuous helical winding of the wire. Alternatively the holes can be drilled into the wire after the tubular member has been produced from the wire. The tubular member is formed such that it comprises enough flexibility that it is able to bend to turn the corner from a main borehole to a lateral drain hole with a small radius of curvature.

The figures show one helically wound wire having a coiled spring-like structure forming the tubular member of the liner. However an alternate form of the tubular member can comprise two or more helically wound wires, each having a coil spring-like structure. For this embodiment the tubular member is formed from a first outer helical wound wire with a second inner helically wound wires residing concentrically within the outer helically wound wire. The second inner helically wound wires forms a spring-like structure having a smaller diameter than the first wound wire, such that it can fit within the first wound wire. This dual coiled wire format allows the liner to be rotated. The liner may need to be rotated to help with insertion into the hole, particularly if resistance is found during the process, and to improve the cement job.

A second embodiment of the invention comprises a liner having spaces between the coils of the tubular member to allow for the flow of fluids from the outside of the liner to the inside. The distance between the coils of the tubular member will depend on the flow rate and the particle dimensions of the formation where the coil spring is to be used.

As the liner is a tubular member formed from continuous helically wound wire when the liner turns into the lateral drain hole from the main borehole the flexibility of the tubular member allows the liner to bend to enter the opening of the lateral borehole with a small radius of curvature.

As lateral drain holes are often unconsolidated the liners can be used as a sand screen in the drain holes to filter sand out of the fluid as it is drawn from the reservoir. The liner is also helps to provide stability to the drain hole by preventing the loosely consolidated or unconsolidated formation from collapsing the drain hole.

Figure 4:
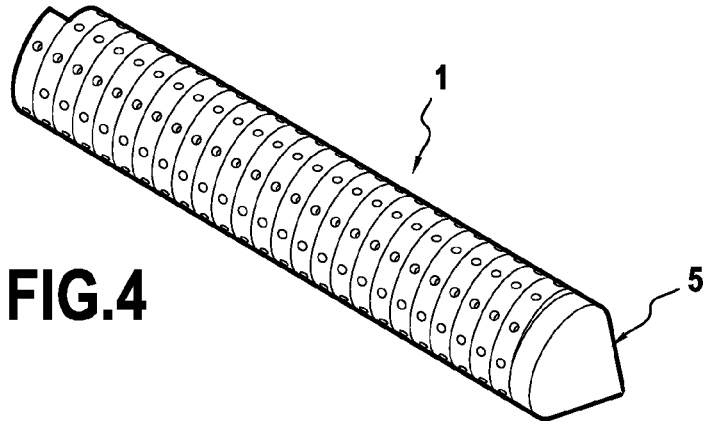
FIG. 4 shows an embodiment of the liner according to the invention.

As shown in FIG. 4 a liner shoe 5 can be placed at the end of the tubular member 2 to close one end of the liner 1. The closed end is at the downhole end of the liner and a cone shape liner shoe helps with the insertion of the liner into the lateral drain hole.

Figure 5:
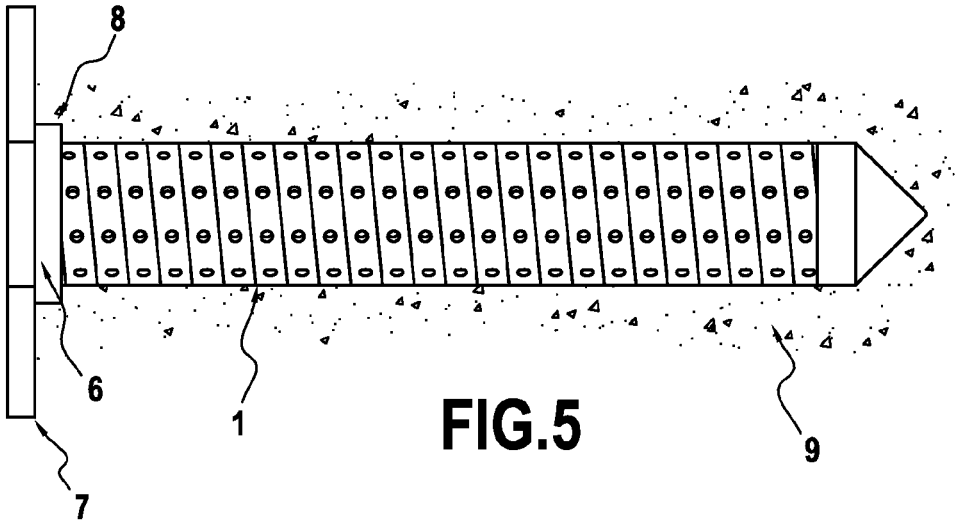
FIG. 5 shows an embodiment of the liner according to the invention in a horizontal drain hole.

As shown in FIG. 5 the liner 1 can comprise a bearing 6 at one end of the liner. The liner is able to pass through the drilled hole of the casing 7 of the main borehole into the lateral drain hole, the bearing 6 at the end of the liner comprises anchoring means 8 such as articulated arms which connect the liner to the main borehole by bolding the liner in place behind the casing 7 in the formation 9. Once the liner has been inserted into the lateral drain hole such that part of the bearing is located in the casing, the arms can extend and secure the liner to the casing in the formation 9.

Figure 6:
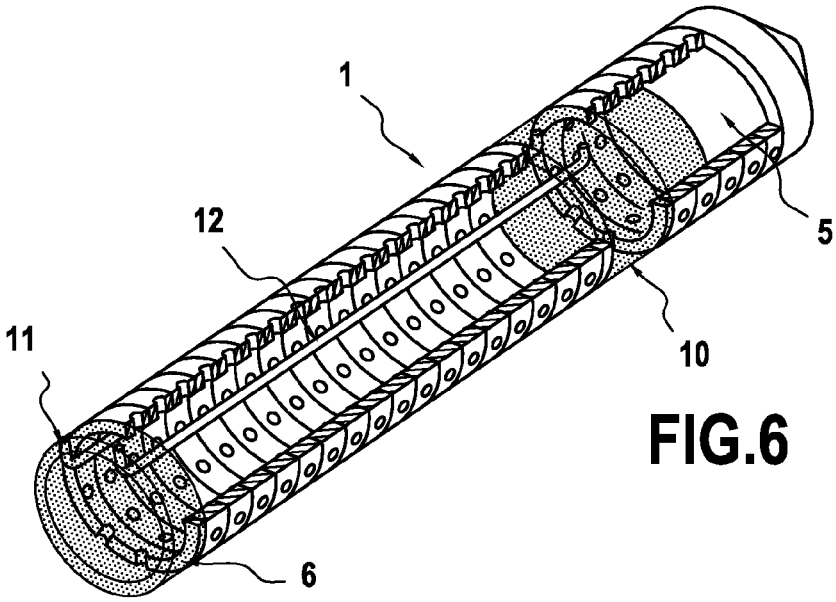
FIG. 6 shows a liner according to the invention for deploying sensors in a drain hole.

With reference to FIGS. 6 and 7 the liner 1 can be used to deploy sensors 10 in the lateral drain hole. Sensors are placed along the liner and are connected to an antenna 11 at the bearing 6. The sensors are connected to the antenna 11 by electrical conductors 12, i.e. wires or cables, running through the liner. The antenna 11 enables data to be received and transmitted from the sensor 10 and communicates with an interrogating tool 13 in the main borehole 14. The interrogating tool 13 can be used to transmit power to the sensors via the antennas and to obtain data from the antennas for conveying the information up to the surface. The sensors can be of any type suitable for use in boreholes to measure the properties of the formation such as pressure or temperatures sensors, or sensors monitoring chemical or electrical or acoustic signals. The liner can be used as both a sand control screen and for positioning sensors or for sensor positioning only. The liner can also be used to position any device to control the flow rate in the lateral drain hole.

With reference to FIG. 8 a flexible liner 1 is placed down the main borehole 14 by a liner deployment tool 15. The liner is pushed down the main borehole and directed into an opening in the casing 7 going to a lateral drain hole 16 that has been drilled into the formation 9 from the main borehole 14 with a small radius of curvature.

With reference to FIG. 9*a-e* a liner deployment tool 15 for inserting the liner into a lateral drain hole comprises a revolving liner storage compartment 17 that can hold multiple liners 1. The deployment tool further comprises a guide 18 that can line up with the opening of the lateral drainhole 16 and has a passageway through which the liner enters from the storage compartment and exits the tool from into the lateral drain hole 16. The exit hole of the guide can be set to the angle of the drain hole, for example 90°, this allows the liner to be inserted into lateral drain holes that are perpendicular to the main borehole.

Figure 9A:
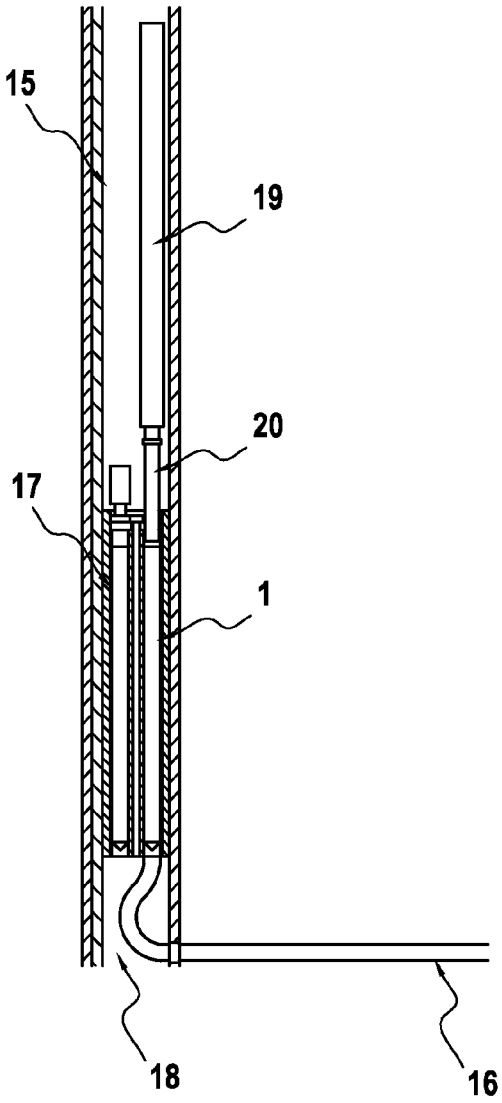
FIGS. 9*a-e* shows the liner deployment tool inserting the liner according to the invention into a horizontal drain hole from a main borehole.
Figure 9B:
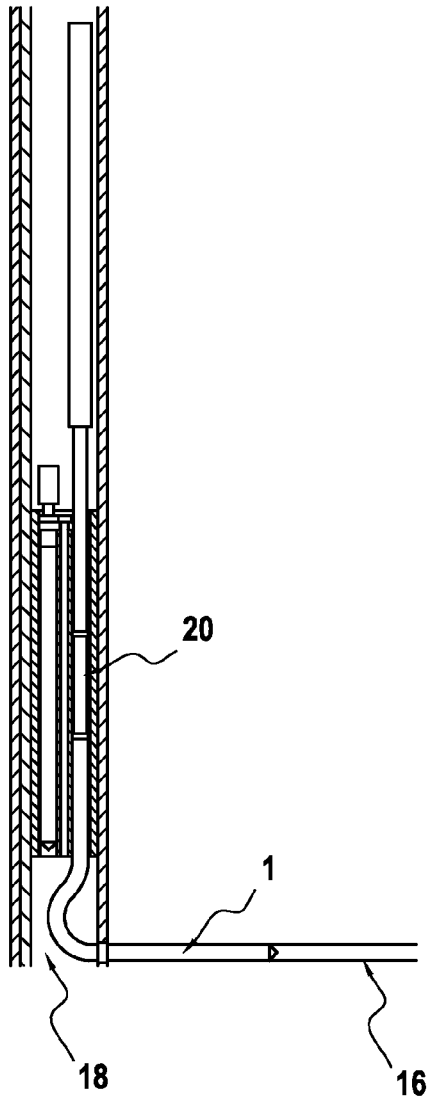
Figure 9C:
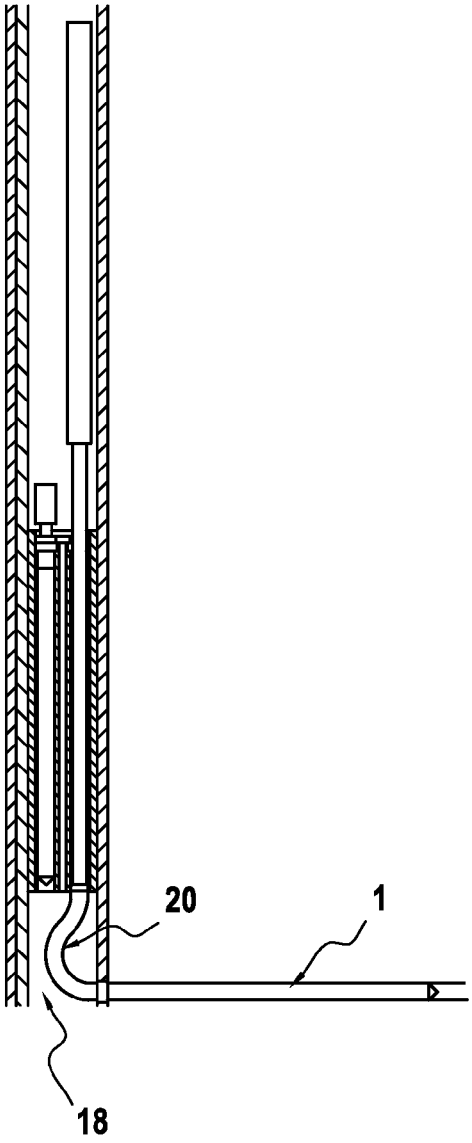

A pusher device 19 having a partial flexible portion 20 at one end pushes the flexible liner 1 out of the storage compartment 17, through the guide 18 and into the drain hole 16, FIGS. 9*b* and 9*c*. The flexible portion of the pusher 19 also enters the guide and allows the liner to be pushed out of the deployment tool into the lateral drain hole. As the liner is pushed through the guide, the guide causes the liner to bend and generate the curvature in the liner needed for it to enter the lateral drain hole at the required angle.

Figure 9D:
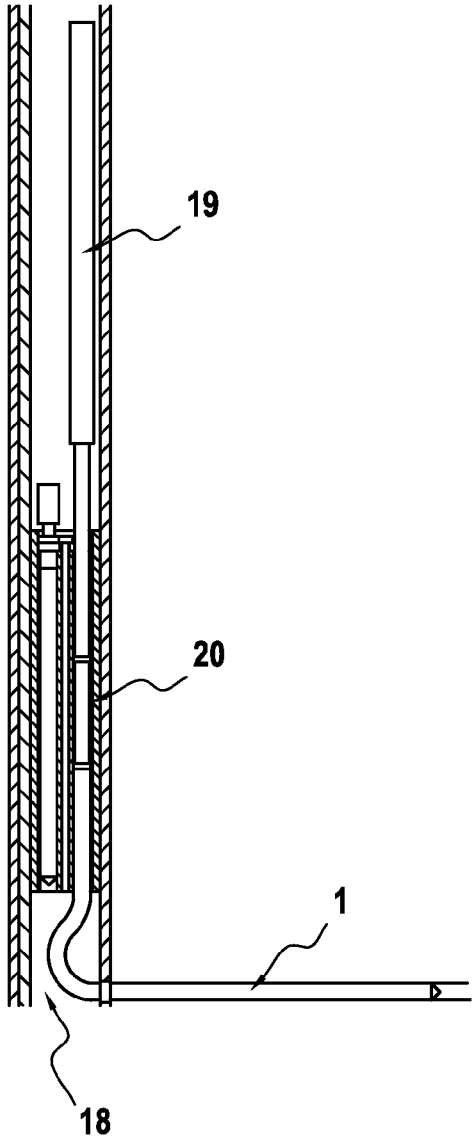
Figure 9E:
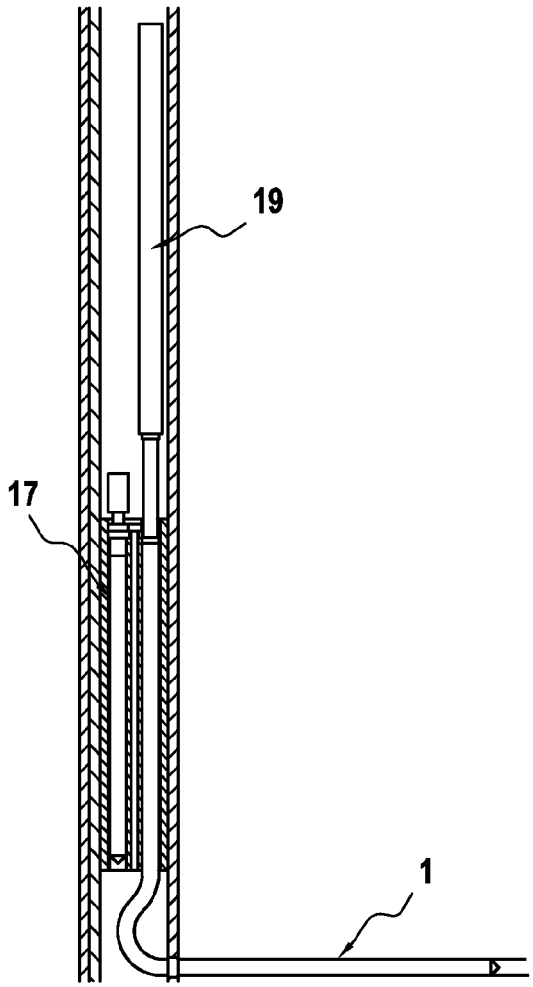
Figure 10:
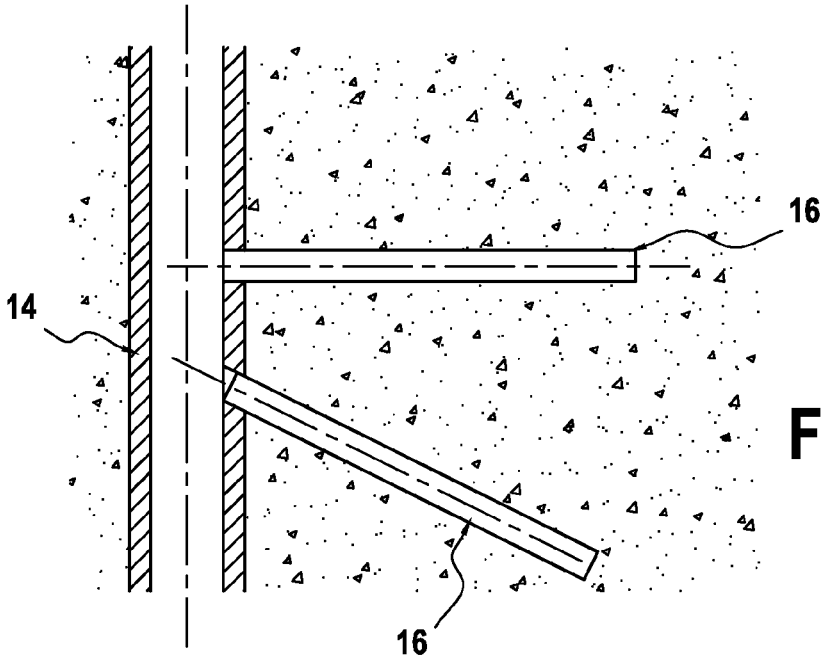
FIG. 10 shows a schematic view of a main borehole with lateral drainholes.

Once the liner is inserted the pusher returns to its starting position, FIGS. 9*d* and 9*e*, and the tool can be positioned in front of the next drain hole for the process to be repeated. While the liner is exemplified inserting into drainholes which are at a 90° angle from the main borehole the liner can be used for inserting into drainholes departing from a main borehole at any angle. FIG. 10 shows different angles that drainholes 16 can depart from the main bore hole 14.

The liner may also comprise other components such as packers for zonal isolation and hydraulic components. While the liner is described to deploy sensors into a lateral borehole, the liner can be used for inserting other device inside the lateral borehole.

The invention claimed is:

1. A liner for inserting into a drain hole, the liner comprising a resilient tubular member with a central bore;

wherein the tubular member is formed from a first continuous helically wound wire provided with a passageway to allow fluid communication across the member, wherein the helically wound wire is formed before inserting into the drain hole at an angle from a borehole, wherein adjacent portions of the helically wound wire fully contact each other so that fluid communication across the member is restricted to the passageway; and wherein the tubular member formed from the helically wound wire is spring-like in having enough flexibility to bend with a curvature needed to enter into the drain hole at the angle.

2. The liner according to claim 1 wherein the passageway is formed by bores through the wire.

3. The liner according to claim 1 wherein the wire has a polygonal cross section.

4. The liner according to claim 1 wherein the wire has a rectangular or square cross section.

5. The liner according to claim 1 further comprising a liner shoe which closes one end of the tubular member.

6. The liner according to claim 5 wherein the liner shoe is in the shape of a cone.

7. The liner according to claim 1 further comprising a bearing at one end of the tubular member.

8. The liner according to claim 6 wherein the bearing comprises anchoring means to hold the liner in place, the anchoring means comprising articulated arms which connect the liner to the borehole by holding the liner in place behind a casing positioned in the borehole.

9. The liner according to claim 1 further comprising sensors.

10. The liner according to claim 9 further comprising an antenna, the sensors placed along the liner and connected to the antenna by electrical conductors running through the liner.

11. The liner according to claim 1 wherein the liner is for a sand control screen.

12. A method of deploying a liner down a borehole comprising inserting the liner according to claim 1 down a borehole and guiding the liner into a lateral drain hole.

13. The method of deploying a liner according to claim 12 wherein the method comprises guiding the liner into a lateral drain hole perpendicular to the borehole.

* * * * *